US011459143B2

(12) United States Patent
Darmon

(10) Patent No.: US 11,459,143 B2
(45) Date of Patent: Oct. 4, 2022

(54) INTEGRATED, PORTABLE AND HYBRID PACKAGE AND CARRIER

(71) Applicant: Christopher M. Darmon, Portland, OR (US)

(72) Inventor: Christopher M. Darmon, Portland, OR (US)

( * ) Notice: Subject to any disclaimer, the term of this patent is extended or adjusted under 35 U.S.C. 154(b) by 0 days.

(21) Appl. No.: 16/941,322

(22) Filed: Jul. 28, 2020

(65) Prior Publication Data

US 2022/0033132 A1 Feb. 3, 2022

(51) Int. Cl.
*B65D 5/38* (2006.01)
*B65D 5/468* (2006.01)
*B65D 5/64* (2006.01)

(52) U.S. Cl.
CPC ..... *B65D 5/38* (2013.01); *B65D 5/4608* (2013.01); *B65D 5/64* (2013.01)

(58) Field of Classification Search
CPC ..... B65D 5/38; B65D 5/2047; B65D 5/029; B65D 5/646
USPC ..... 229/913, 125.12–125.125, 112–114
See application file for complete search history.

(56) References Cited

U.S. PATENT DOCUMENTS 312,421 A * 2/1885 Bauer ..... B65D 5/48038 206/521.1
542,903 A * 7/1895 Truax ..... B65D 5/727 229/125.05
2,312,598 A * 3/1943 Sprague ..... B65D 5/4608 229/117.16
2,481,871 A * 9/1949 Potts ..... B65D 5/4608 229/117.16
2,722,361 A * 11/1955 Kindseth ..... B65D 5/38 383/211
3,141,599 A * 7/1964 Hasselhoff ..... B65D 5/38 229/117.13
3,160,326 A * 12/1964 Sturdevant ..... B65D 5/5045 222/466
3,650,383 A * 3/1972 Nigro ..... B65D 5/3635 229/162.1

(Continued)

FOREIGN PATENT DOCUMENTS

EP 2143649 A1 * 1/2010 ..... B65D 5/321
EP 3929098 A1 * 12/2021

(Continued)

*Primary Examiner* — Christopher R Demeree
*Assistant Examiner* — Phillip D Schmidt
(74) *Attorney, Agent, or Firm* — Jonathan B. David

(57) ABSTRACT

Embodiments disclosed herein relate to a hybrid package and carrier system. The system can include a container for storing a plurality of items set at a first position, wherein the container is configured with a trapezoidal configuration. The system can also include the plurality of items set at a second position, wherein the plurality of items are positioned within the container to enable the container to store the plurality of items. Further, the system can include a cover set at a third position with a trapezoidal shape, wherein the cover is positioned over the container to protect the plurality of items stored in the container. The system can also include a handle configured to an exterior portion of the cover with the trapezoidal shape, wherein the handle is set to lift the cover along with the plurality of items stored within the container in a vertical direction.

20 Claims, 9 Drawing Sheets

Multiple carriers stack for retail storage, inventory management and shipping

(56) References Cited

U.S. PATENT DOCUMENTS

| | | | | | |
|---|---|---|---|---|---|
| 4,017,015 | A * | 4/1977 | Jefferson | E01H 1/1206 | 294/1.3 |
| 5,584,430 | A * | 12/1996 | Mulry | B65D 5/543 | 229/117.16 |
| 5,655,660 | A * | 8/1997 | Dolin | B65D 5/38 | 206/493 |
| 5,673,796 | A * | 10/1997 | Tulloch | B65D 5/4216 | 206/769 |
| 9,637,304 | B2 * | 5/2017 | Tseng | B65D 85/18 | |
| 10,654,634 | B2 * | 5/2020 | Mabrey | B65D 5/703 | |
| 2006/0231602 | A1 * | 10/2006 | Mu | B65D 5/38 | 229/125.015 |
| 2007/0039840 | A1 * | 2/2007 | Mu | B65D 5/46024 | 206/278 |
| 2008/0054054 | A1 * | 3/2008 | Cheng | B65D 5/321 | 229/117.13 |
| 2015/0021329 | A1 * | 1/2015 | Darmon | A47B 87/0292 | 220/345.1 |
| 2018/0134441 | A1 * | 5/2018 | Milicaj | B65D 5/38 | |
| 2019/0135516 | A1 * | 5/2019 | Mabrey | B65D 5/60 | |

FOREIGN PATENT DOCUMENTS

| | | | | | |
|---|---|---|---|---|---|
| FR | 1100268 | A | * | 9/1955 | |
| FR | 2573038 | A1 | * | 5/1986 | |
| GB | 1345458 | A | * | 1/1974 | |
| KR | 20090003846 | U | * | 4/2009 | |
| KR | 200445296 | Y1 | * | 7/2009 | |
| KR | 20110006414 | U | * | 6/2011 | |
| WO | WO-2008032889 | A1 | * | 3/2008 | B65D 5/38 |

* cited by examiner

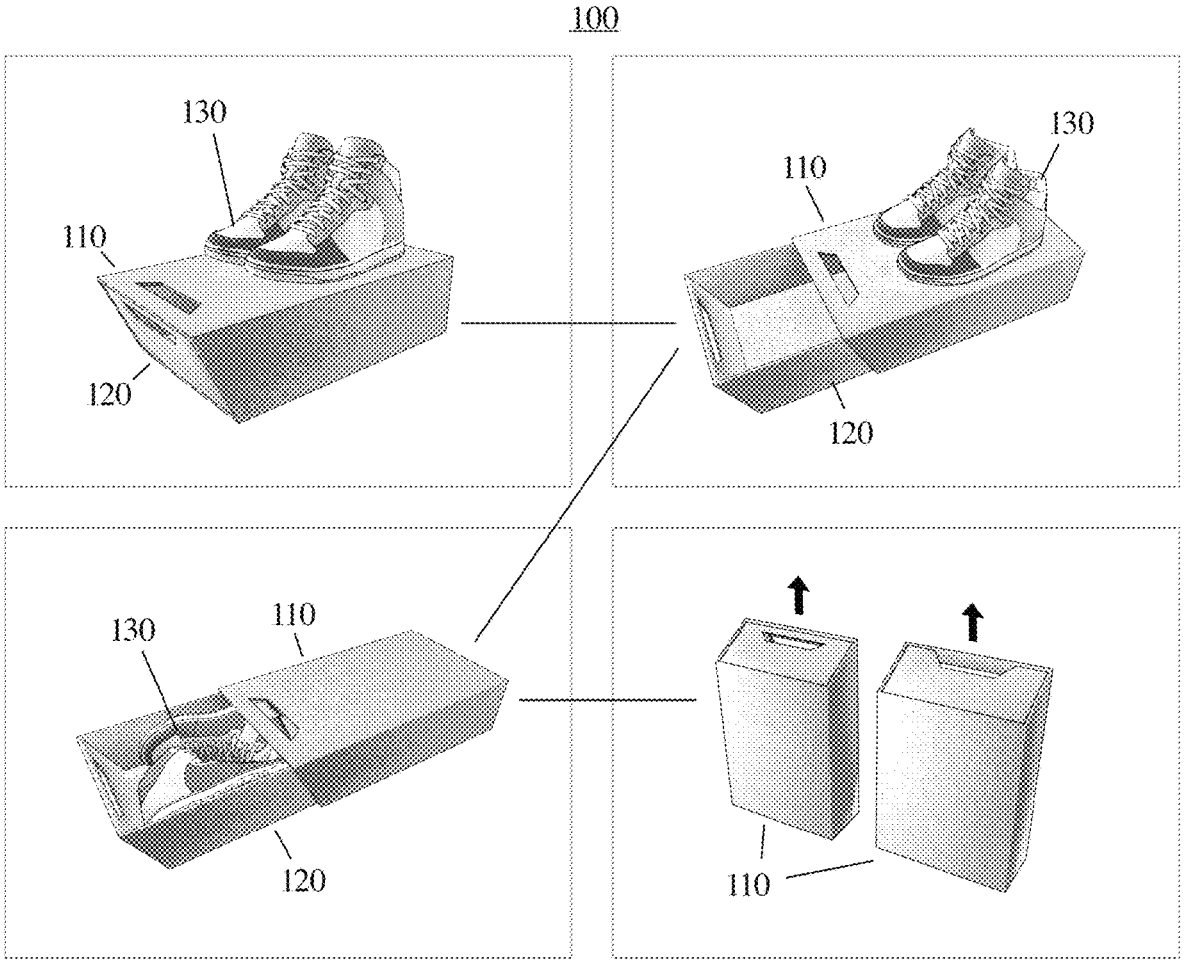
FIG. 1 - "Integrated Handled Packaging and Carriers" / Two-piece sliding design

200

Two-piece sliding design works for both shoes (fashion and apparel) and electronics (tablets, laptops, headphones and computer accessories)

300

"Integrated Handled Packaging and Carriers" / Two-piece sliding design consisting of a cover (exterior shell) and container (inner tray).

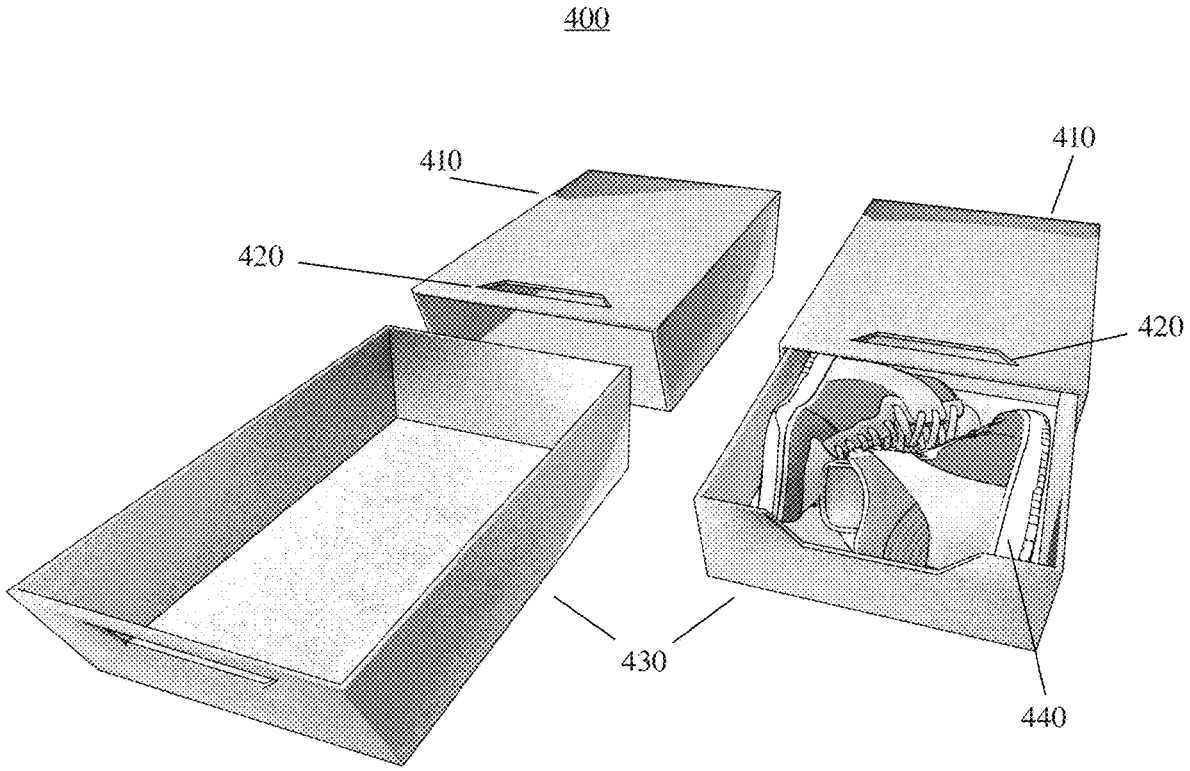
FIG. 4 - "Integrated Handled Packaging and Carriers" / Two-piece sliding design

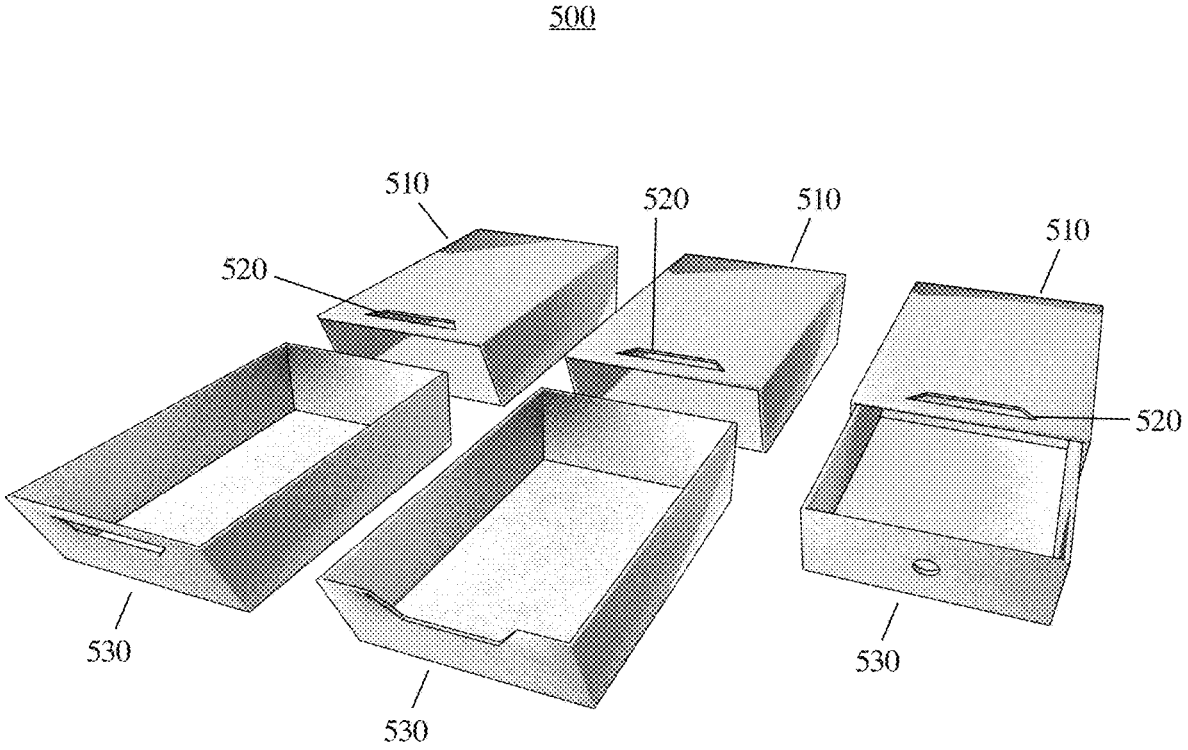
FIG. 5 - "Integrated Handled Packaging and Carriers" / Two-piece sliding design

600

Multiple cover (exterior shell) options made from corrugate, e-flute or paper pulp

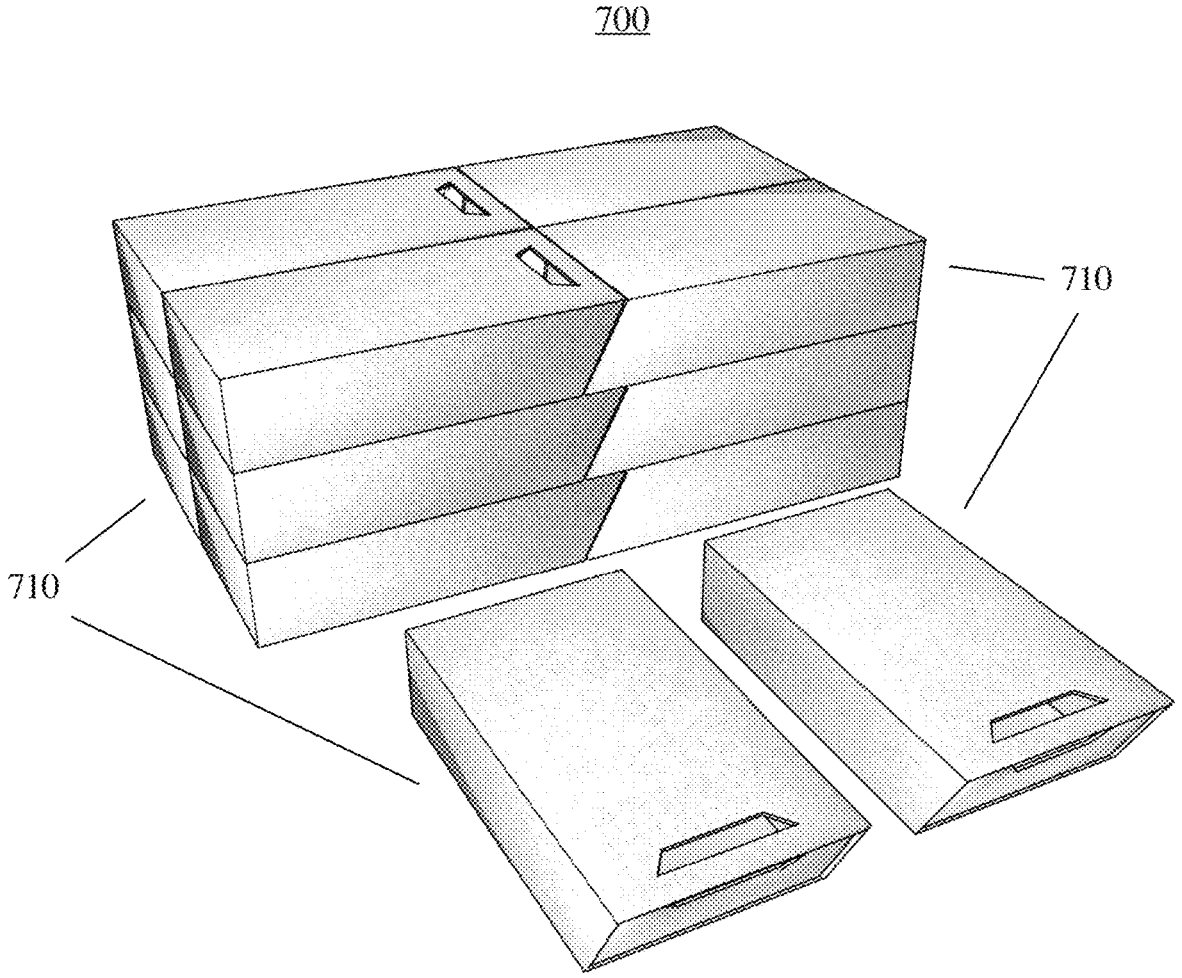
FIG. 7 - Multiple carriers stack for retail storage, inventory management and shipping

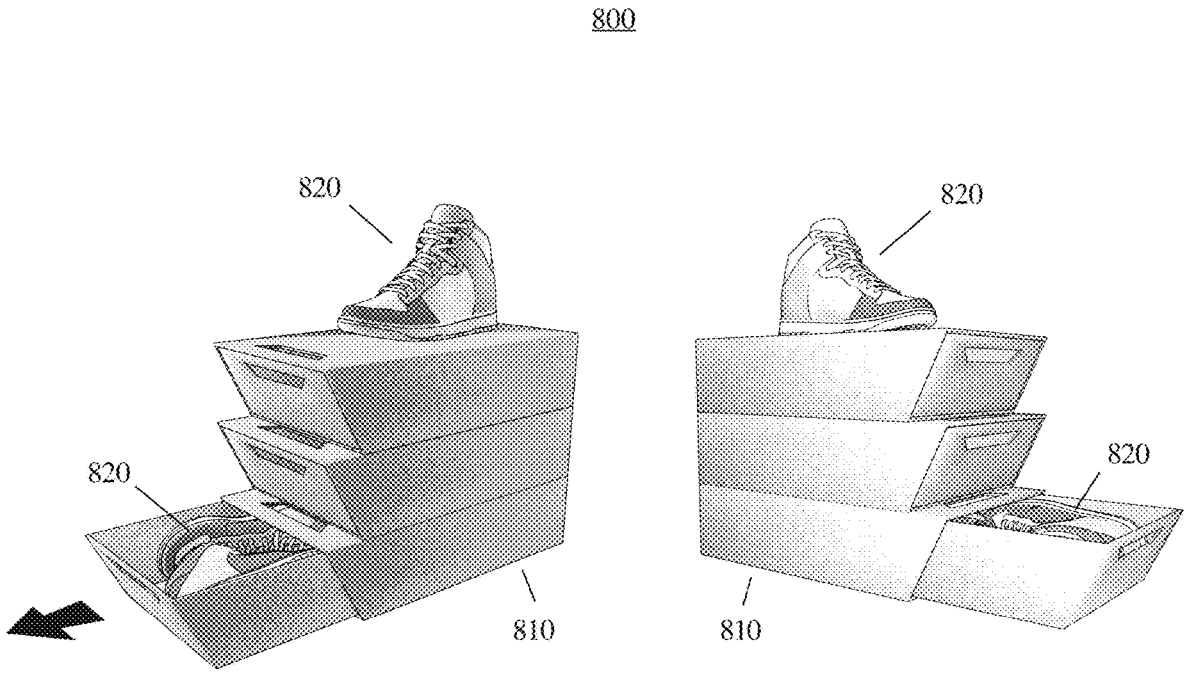
FIG. 8 - Multiple carriers stack for retail storage, inventory management and shipping

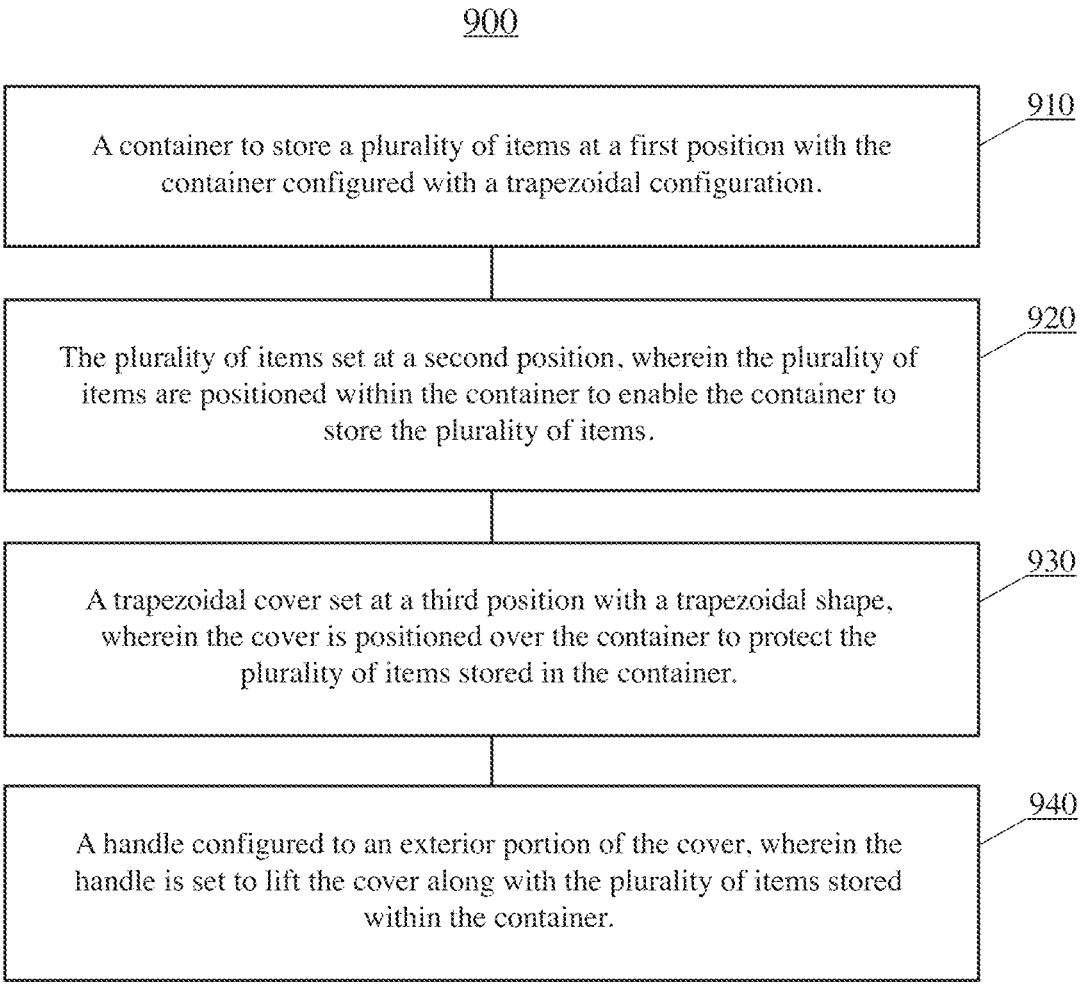
FIG. 9 - "Integrated Handled Packaging and Carriers" - Flowchart

INTEGRATED, PORTABLE AND HYBRID PACKAGE AND CARRIER

TECHNICAL FIELD

The present disclosure generally relates to an integrated and portable and hybrid package and carrier system. More specifically, the present invention provides a system for storing and carrying items within a hybrid package and carrier. The hybrid package and carrier can be used to store and carry a plurality of items of various sizes.

BACKGROUND

Consumers who purchase shoes usually have to place their desired shoes in a box with fixed or static dimensions. The shoes must be able to fit within the box. Neither the shoes nor the box can be adjusted to ensure that the shoes can securely fit into the box without any unnecessary space between the shoes and the length and width of the interior of box. Moreover, if the shoes do not fit into the box, another box has to be selected.

After a consumer has obtained a box in which the prospective shoes fit into, the consumer must then make sure that the shoes are not damaged while in the box. The consumer must ensure that as the box is being carried, the shoes do not slide or move inside of the box and are damaged as a result. Another issue that can arise is that the consumer cannot lift and carry the box without a shopping. Although a consumer can use his hands to carry the lift and carry the box, the consumer may often have to lift and carry the box in a cumbersome manner, especially if the consumer has other items which he/she may be carrying. As a result, a shopping bag typically has to be used to carry the shoebox with the pair of shoes. The consumer wishing to carry the box without the use of a shopping bag often cannot due so by a safe and efficient means.

Therefore, it is imperative for consumer to be able to find a box or package that can adjust to the dimensions of the items which the consumer wishes to store. In addition, it is also imperative that the consumer is able to carry the items safely and efficiently without having to use a traditional shopping bag or the like.

SUMMARY

An embodiment relates to a system comprising: a container for storing a plurality of items set at a first position, wherein the container is configured with a trapezoidal configuration. The system may also comprise the plurality of items set at a second position, wherein the plurality of items are positioned within the container to enable the container to store the plurality of items. The system may further comprise a cover set at a third position with a trapezoidal shape, wherein the cover is positioned over the container to protect the plurality of items stored in the container. The system may also comprise a handle configured to an exterior portion of the cover with the trapezoidal shape, wherein the handle is set to lift the cover along with the plurality of items stored within the container.

The system includes the handle being integrated into the cover.

The length of the handle is adjustable.

The container is made of recyclable and/or adjustable material

A system comprises a trapezoidal container of a fixed length configured at a first position to store one or more items. The system may also the one or more items positioned at a second position outside of the trapezoidal container. The system can also include a trapezoidal cover positioned over the trapezoidal container, wherein the trapezoidal cover is configured to cover the trapezoidal container when the one or more items are positioned within the trapezoidal container. Further, the system can include an adjustable handle positioned on the trapezoidal cover, wherein the adjustable handle is configured to lift the trapezoidal cover simultaneously with the one or more items and the trapezoidal container in a vertical direction.

The system can also include the one or more items placed within the container.

The width of the handle is increased in proportion to a width of the container.

The length of the adjustable handle within the cover is adjusted to lift the trapezoidal cover and the trapezoidal container.

A length of the trapezoidal cover is adjusted in response to a length of the one or more items.

A method comprising positioning a trapezoidal container at a first position, wherein the trapezoidal container is configured to store a plurality of items. The method may also include setting the plurality of items at a second position, wherein the plurality of items are positioned within the trapezoidal container. Further, the method may include placing a trapezoidal cover above the trapezoidal container, wherein the trapezoidal cover is positioned to protect the plurality of items and the trapezoidal container. In addition, the method may include configuring an adjustable handle on external portion of the trapezoidal cover; wherein the handle is positioned to lift the trapezoidal cover with the plurality of items and the trapezoidal container in a vertical direction.

A length of the trapezoidal container is extended in response to a length of the plurality of item.

A width of the trapezoidal container is increased in response to a width of the plurality of items.

A width of the trapezoidal cover is increased in proportion to a width of the trapezoidal container.

A width of the handle is adjusted in response to a width of the plurality of items.

Other contemplated embodiments can include objects, features, aspects, and advantages in addition to or in place of those mentioned above. These objects, features, aspects, and advantages of the embodiments will become more apparent from the following detailed description, along with the accompanying drawings.

BRIEF DESCRIPTION OF THE FIGURES

The system of providing an integrated and hybrid container and carrier for shoes and other items is illustrated in the figures of the accompanying drawings which are meant to be exemplary and not limiting, in which like reference numerals are intended to refer to like components, and in which:

FIG. 1 illustrates an overview figure of the hybrid package and carrier in accordance with an embodiment of the presently disclosed embodiments;

FIG. 4 illustrates various diagrams of the hybrid package and carrier in accordance with an embodiment of the presently disclosed embodiments;

FIG. 5 illustrates various diagrams of the hybrid package and carrier in accordance with an embodiment of the presently disclosed embodiments;

FIG. 7 illustrates various diagrams of the hybrid package and carrier in accordance with an embodiment of the presently disclosed embodiments;

FIG. 8 illustrates several diagrams of the hybrid package and carrier in a stacking system in accordance with an embodiment of the presently disclosed embodiments; and FIG. 9 illustrates a flowchart describing the process for the hybrid package and carrier to store and carry various items in accordance with an embodiment of the presently disclosed embodiments.

Figure 2A:
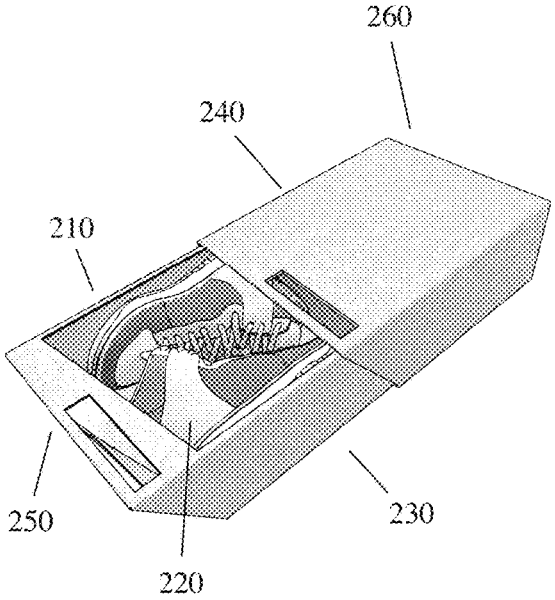
FIGS. 2A-2B illustrate features of the container of the hybrid package and carrier in accordance with an embodiment of the presently disclosed embodiments.

Unless otherwise indicated illustrations in the figures are not necessarily drawn to scale.

DETAILED DESCRIPTION

Background and Context

The disclosed embodiments are best understood by reference to the Figures and detailed description herein.

Disclosed embodiments of the invention are discussed below with reference to the Figures. However, those skilled in the art will appreciate that the detailed description provided herein with respect to these figures is for explanatory purposes as the invention may extends beyond these currently disclosed embodiments. Various alternate approaches to implement the functionality of any given detail described herein is envisioned. That is, there are modifications and variations of the invention that are too numerous to be listed but that all fit within the scope of the invention. Also, singular words should be read as plural and vice-versa, where appropriate, and alternative embodiments do not imply mutual exclusivity.

It is to be further understood that the disclosed embodiments are not necessarily limited to the particular methodology, techniques, uses, and applications, described herein, as these may vary. It is also to be understood that the terminology used herein is used for the purpose of describing particular embodiments only, and is not otherwise intended to limit the scope of the present invention. It must be noted that as used herein in the detailed description and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Physical and/or conceptual structures described herein are to be understood also to refer to functional equivalents of such structures.

All words of approximation as used in the present disclosure and claims should be construed to mean "approximate," rather than "perfect". Words of approximation, include, yet are not limited to terms such as "substantial", "nearly", "almost", "about", "generally", "largely", etc.

Terms of degree are not necessarily indefinite. "Claim language employing terms of degree has long been found definite where it provided enough certainty to one of skill in the art when read in the context of the invention." *Interval Licensing LLC v. AOL, Inc.,* 766 F.3d 1364, 1370, 112 USPQ2d 1188, 1192-93 (Fed. Cir. 2014) (citing *Eibel Process Co. v. Minnesota & Ontario Paper Co.,* 261 U.S. 45, 65-66 (1923. Thus, when a term of degree is used in the claim, the examiner should determine whether the specification provides some standard for measuring that degree. *Hearing Components, Inc. v. Shure Inc.,* 600 F.3d 1357, 1367, 94 USPQ2d 1385, 1391 (Fed. Cir. 2010); *Enzo Biochem, Inc., v. Applera Corp.,* 599 F.3d 1325, 1332, 94 USPQ2d 1321, 1326 (Fed. Cir. 2010); *Seattle Box Co., Inc. v. Indus. Crating &Packing, Inc.,* 731 F.2d 818, 826, 221 USPQ 568, 574 (Fed. Cir. 1984).

The term "substantially" is often used in conjunction with another term to describe a particular characteristic of the claimed invention. It is a broad term. *In re Nehrenberg,* 280 F.2d 161, 126 USPQ 383 (CCPA 1960). The court held that the limitation "to substantially increase the efficiency of the compound as a copper extractant" was definite in view of the general guidelines contained in the specification. *In re Mattison,* 509 F.2d 563, 184 USPQ 484 (CCPA 1975).

All questions of enablement are evaluated against the claimed subject matter. The focus of the examination inquiry is whether everything within the scope of the claim is enabled.

Unless defined otherwise, all technical and scientific terms used herein have the same meanings as commonly understood by one of ordinary skill in the art to which the disclosed embodiments belong. Preferred methods, techniques, devices, and materials are described, although any methods, techniques, devices, or materials similar or equivalent to those described herein may be used in the practice or testing of the present invention.

Although Claims have been included in this Application to specific enumerated combinations of features, it should be understood that the scope of the present disclosure also includes any novel feature or any novel combination of features disclosed herein.

References "an embodiment," "example embodiment," "various embodiments," "some embodiments," etc., may indicate that the embodiment(s) so described may include a particular feature, structure, or characteristic, but not every possible embodiment necessarily includes that particular feature, structure, or characteristic.

References to "user", or any similar term, as used herein, may mean a human or non-human (e.g., computer-based) user thereof. Moreover, "user", or any similar term, as used herein is contemplated to mean users at any stage of a usage process.

References to "person", "individual", "human", "a party", or any similar term, as used herein, it should be understood that such references are sole by way of example Headings provided are for convenience and are not to be taken as limiting the present disclosure in any way.

Each term utilized herein is to be given its broadest interpretation given the context in which that term is utilized.

Terminology

The following paragraphs provide context for terms found in the present disclosure (including the claims):

The transitional term "comprising", which is synonymous with "including," "containing," or "characterized by," is inclusive or open-ended and does not exclude additional, unrecited elements or method steps. See, e.g., *Mars Inc. v. H. J. Heinz Co.,* 377 F.3d 1369, 1376, 71 USPQ2d 1837, 1843 (Fed. Cir. 2004) ("[L]ike the term 'comprising,' the terms 'containing' and 'mixture' are open-ended."). "Configured to" or "operable for" is used to connote structure by indicating that the mechanisms/units/circuits/components include structure that performs the task or tasks during operation. "Configured to" may include adapting a manufacturing process to fabricate components that are adapted to implement or perform one or more tasks.

"Based On." As used herein, this term is used to describe factors that affect a determination without otherwise precluding other or additional factors that may affect that determination. More particularly, such a determination may be solely "based on" those factors or based, at least in part, on those factors.

All terms of example language (e.g., including, without limitation, "such as", "like", "for example", "for instance", "similar to", etc.) are not exclusive of other examples and therefore mean "by way of example, and not limitation . . . ".

A description of an embodiment having components in communication with each other does not infer that all enumerated components are needed.

A commercial implementation in accordance with the scope and spirit of the present disclosure may be configured according to the needs of the particular application, whereby any function(s of the teachings related to any described embodiment of the present invention may be suitably changed by those skilled in the art.

Aspects of the present invention are described below with reference to flowchart illustrations and/or block diagrams of methods and systems according to the disclosed embodiments.

The flowchart and diagrams in the figures illustrate the architecture, functionality, and operation of possible implementations of systems and methods according to various embodiments. In this regard, each block in the flowchart or diagrams may represent a segment which comprises one or more executable instructions for implementing the specified function(s). Functions noted in the block may occur out of the order noted in the figures. For example, two blocks shown in succession may, in fact, be executed substantially concurrently, or the blocks may sometimes be executed in the reverse order, depending upon the functionality involved.

Further, any sequence of steps that may be described does not necessarily indicate a condition that the steps be performed in that order. Some steps may be performed simultaneously.

Where carriers are described, it will be understood by those of ordinary skill in the art that: (i) packages and carriers alternative to those described may be implemented. Any schematic illustrations and accompanying descriptions of any sample hybrid package carriers presented herein are example arrangements.

More specifically, as will be appreciated by one skilled in the art, aspects of the present invention may be embodied as a system or method. Furthermore, aspects of the present invention may take the form of a package and carrier of a variety of different sizes.

Introduction

The present invention provides a system storing and carrying a plurality of items, such as a pair of shoes, in a hybrid package and carrier. A hybrid package and carrier can function like a package in which can store items such as shoes, books, notebook computers and other such items. In addition, the hybrid package and carrier can also be used to lift and carry such items within the same package without the use of an external handle or a plastic bag that includes a handle. Currently, the use of plastic bags to carry items has been outlawed in several jurisdictions. Accordingly, in such jurisdictions, consumers often can have difficulty carrying items such as boxes without a handle or a bag which can enable the consumer to more efficiently carry such items such as books and shoes. Consumers often will have to carry such items by hand, which can often be cumbersome and inefficient. The consumer may risk damaging such items by dropping the items accidentally or accidentally bumping the items against other obstacles in their path.

Items such as a pair of shoes can be positioned next to, or on top of, the hybrid package and carrier. The hybrid package and carrier can be made of multiple parts. The multiple parts can include a slidable container/tray and an exterior shell/cover. To place the pair of shoes within the container, the container must be slid out from underneath the cover. Upon the container being positioned apart from the cover, the pair of shoes can be placed within the container. In other embodiments described below, the dimensions of the container, such as the length, width, and height of the container, may be adjusted to accommodate the size of the shoes. The container can be made of recyclable and adjustable materials. The recyclable materials can include recycled cardboard and paper pulp or the like. The recycled cardboard and paper pulp can be used to make the exterior shell/cover and the slidable tray/container. As the shoes are secured within the container, the container may then be slid back to its original position underneath the cover.

The cover may include an integrated handle. A portion of the cover is left open. The open portion of the cover can function as a handle. Accordingly, after the pair of shoes have been secured within the container, and the cover has been placed back over the container, a user can lift the entire package using the handle which is integrated into the cover. The integrated package can function as a carrier has it can be held securely in the vertical direction by the handle. In addition, the handle can then carry the package including the cover, pair of shoes, and container in the horizontal direction.

In one or more embodiments, the cover can have its length, width and height modified to accommodate the different sizes and shapes of the pair of shoes in correlation with the container. The cover can be made of recyclable and adjustable materials such as recycled cardboard and paper pulp. The cover's dimensions can also be modified to accommodate other items such as books, laptop computers, cards, food, etc.

Further, in various embodiments, the handle may be modified depending on the items being stored within the container. For larger items, the handle can be enlargened to ensure the entire package can be carried securely. Similarly, the handle can also be reduced when necessary to make it easier and functional for the integrated package to function as a carrier.

System Structure

FIG. 1 illustrates an overview for the present invention. A hybrid package and carrier system 100 is illustrated in a sequence of frames. A trapezoidal tray or container 120 can be positioned inside of a trapezoidal external shell or cover 110. An integrated handle may also be part of the cover 110. The integrated handle can be formed from an open portion of the cover 110. A pair of shoes 130 can rest next to or on top of the system 100. The slidable container 120 can slide out away from the cover 110 to be separated from the cover 110. The container 120 needs to separate from the cover 110 to store the pair of shoes 130. The pair of shoes 130 may then be placed within the container 110. The container's 110 dimensions may be adjusted if needed as shown below in other embodiments. The length and width of the container can be adjusted to either add space to store the shoes 130, or to reduce any unnecessary space. Further, the height of the container 110 can also be increased to securely store the pair of shoes 130.

In FIG. 1, the cover 110 may then be placed over the shoes 130 and the container 120 once the shoes 130 are secured within the container 120. Similar to the container 120, the dimensions of the cover 110 may be adjusted to ensure that the shoes 130 are securely stored. The cover 110 may also have its length, height and width adjusted to create additional space that is directly proportional with the adjustments to the container 120. Further, the cover 110 can also reduce any unnecessary space and decrease its length, height and width in proportion to the changes that the container 120 has made to its length, height and width.

Referring to FIG. 1, as the cover 110 is secured over the shoes 130 that are positioned within the container 120, the handle can be used to lift the cover 110, shoes 130, and container 120 in the vertical direction. Once the system 100 is lifted, the handle can also be used to carry the cover 110, shoes 130, and container 120 in the horizontal direction for any required distances. The handle is integrated into the cover 110. Accordingly, the handle can be used to lift and carry the cover 110, shoes 130 and container 120 without the need for a traditional shopping bag, and also without the need for an external handle. Other embodiments will illustrate how the dimensions of the handle may be adjusted when required.

Figure 2B:
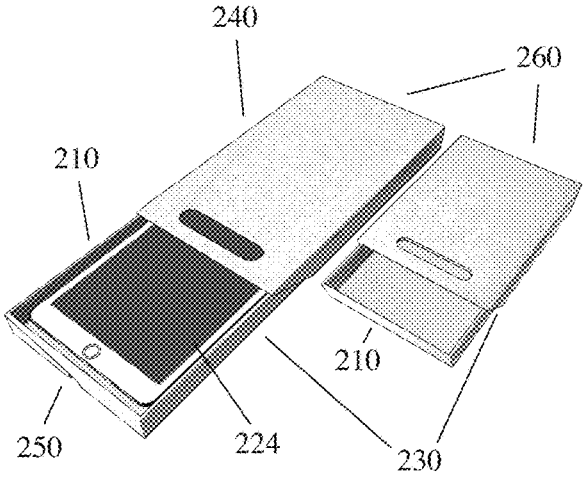

FIG. 2(*a*) illustrates the slidable tray or container 210 of the hybrid package and carrier system 200. In an embodiment, the container 210 can have a trapezoidal configuration. The container 210 can store items 220 such as shoes. In other embodiments, items such as books, cards, laptop computers and other items that can fit within the container 210. The container 210 may also include two side portions 230 and 240 that can stretch along a length of the container 210. In an embodiment, the length of the shoes 220 should be less than the length of the side portions 230, 240 to enable the shoes 220 to fit securely within the container 210. When the length of the shoes 220 is less than the length of the side portions 230, 240, the shoes 220 may be fit within the container 210. The container 210 may also include a front portion 250 and a back portion 260. The front portion 250 and the back portion 260 may both fit along the width of the container 210. The width of the shoes 220 should be less than the width of the front and back portion 250, 260 to fit within the base of the container 210. A height of the container 210 may remain constant when the shoes 220 in their original size can fit securely within the container 210.

In FIG. 2(*b*), the smaller items such as a notebook computer 224 may not require the additional space that the container 210 provides. The dimensions of the container 210 may need to be adjusted to eliminate any unnecessary space for the notebook computer 224. Any unnecessary space can cause the notebook computer 224 to not be held in place securely when the container 210 is later being carried. If the notebook computer 224 is not held securely in place, during the carriage phase, the notebook computer 224 can get damaged by sliding against the side portions 230, 240 and/or the front portion 250 and the back portion 260. The dimensions of the container 210 can be adjusted to avoid the notebook computer 224 sliding against the side portions 230, 240 and the front portion 250 and back portion 260.

In FIG. 2(*b*), Accordingly, the length of the side portions 230, 240 can be adjusted. In an embodiment, the length of the side portions 230. 240 can be equal to each to each other. The width of the front portion 250 and the back portion 260 may also be determined. In an embodiment, the width of the front portion 250 can be equal to the width of the back portion 260. Upon determining the length of the side portions 230, 240, and the width of the front portion 250 and back portion 260, the notebook computer 224 whose length is less than the length of the side portions 230, 240 and whose width is less than the width of the front portion 250 and the back portion 260 can be accommodated by new dimensions for the container 210.

As illustrated in FIG. 2(*b*), the length of the side portions 230, 240 can be reduced as compared to FIG. 2(*a*), and the width of the front and back portion 250, 260 can be reduced in comparison to FIG. 2(*a*). In addition, the height can also be reduced to accommodate the smaller sizes of the notebook computer 224. With the adjusted dimensions, the notebook computer 224 can be placed securely in the container 210 without any unnecessary space between the shoes and the dimensions of the container 210 that can lead to damage of the notebook computer 224 during carriage.

In FIGS. 2(*a*)-(*b*), as the container 210 is configured with the various dimensions, and includes a pair of shoes 220 positioned within the base of the container 210, the container 210 requires a cover. Moreover, the container 210 requires a cover with the same trapezoidal shape and dimensions to enable the shoes 220 or notebook computer 224 to be protected and to also ensure the functionality of the container 210.

Figures 3A, 3B, 3C:
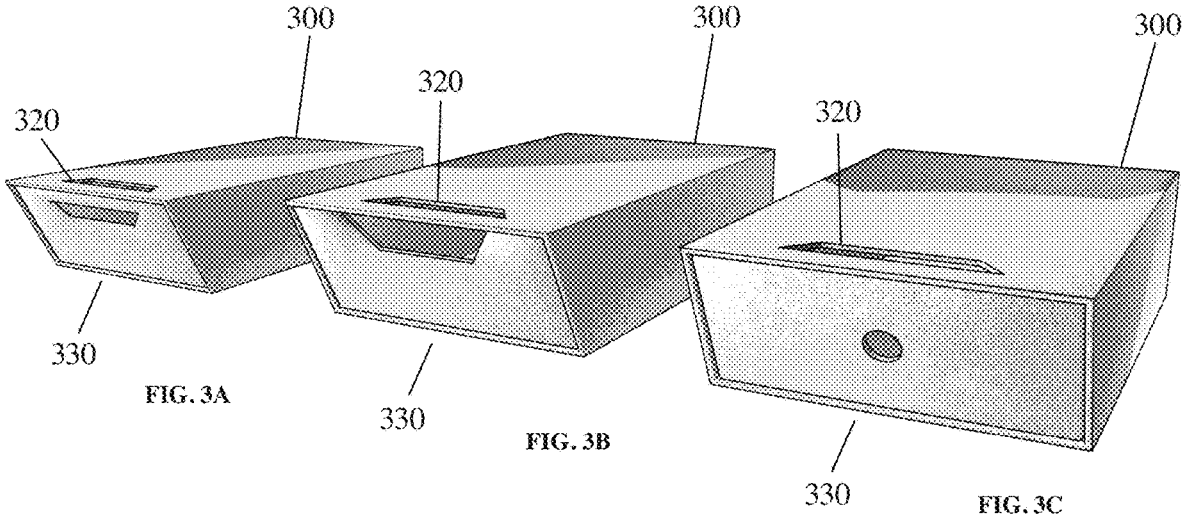
FIGS. 3A-3C illustrate various diagrams of the cover of the hybrid package and carrier in accordance with an embodiment of the presently disclosed embodiments.

FIG. 3(*a*) illustrates an external shell or cover 300. In an embodiment, the cover 300 can be a trapezoidal shaped cover that is the same or substantially similar to the trapezoidal shape of the container 210 in FIGS. 2(*a*)-2(*b*). The cover 300 can have the same length, width and height as the container 210 described in FIG. 2.

Referring to FIG. 3(*a*), the cover 300 configured with the same trapezoidal shape and can be placed over a container 330 positioned with a pair of shoes or other items. The cover 300 can be placed over the container 330, and in contact with the container 330. A handle 320 can be integrated into the cover 300. Once the cover 300 is positioned over the container and in contact with the container, the cover 300 can protect any shoes or other items which may be inside of the container. Further, the cover 300 can also protect the inside of the container from any debris or other items or the like which may originate outside of the cover 300.

In FIG. 3(*a*), the dimensions of the cover 300 may be adjusted to correspond to the size of the shoes or other items within the container 330. If the length and width of items make it difficult to eliminate any unnecessary space that can lead to damage of the items, dimensions of the cover 300 can be adjusted. As with the container 300, the length, width and height of the cover 300 can be reduced to eliminate any unnecessary space, and also correlate to the adjustment made to the dimensions of the container 330 to eliminate the unnecessary space. Moreover, the cover 300 may also flatten to eliminate unwanted space that can lead to the items within the container 330 becoming damaged.

Referring to FIG. 3(*a*), the cover 300 also be adjusted to accommodate smaller objects such as laptop computers or books that may not require the additional space that a pair of shoes may require. Adjusting the various dimensions of the cover 300 in correlation to the adjustments made to the dimensions of the container 330 can enable a smaller pair of shoes and smaller sized objects to be secured without any unnecessary space that could lead to damage during the carriage phase.

In FIG. 3(*b*), an average or typical size of the cover 300 is illustrated. the cover 300 may placed over a pair shoes or other items within the slidable container 330. When the items have been secured within the container 330, the cover 300 may be placed over the items to protect the the items secured within the container 330. A top region of the cover 300 can include an integrated handle 320 and similarly in FIG. 3(*c*). Once the cover 300 is securely placed over the items within the container 330, the handle 320 can be used to lift the cover 300 along with any items and the container 330, as shown previously in FIG. 1. In addition, with the use of the handle 320, the cover 300, and the container 330 with any items can together be carried in the horizontal direction during a carriage phase of the integrated and portable package and carrier Referring to FIG. 3(*c*), the cover 300 may also be expanded in correlation with the container 330 to items that may be larger than shoes and a series of items that may require more space. To accommodate a larger pair of items or the series of items (such as a series of books, etc.), the dimensions of the cover 300 may also be increased in conjunction with the changes made to the dimensions of the container 330. Moreover, either the narrowing or increasing of the dimensions of the cover 300, the changes made to the cover 300 must correspond exactly with the adjusted dimensions of the container 330, or be substantially similar to the adjusted dimensions of the container 330.

In FIG. 3(*c*), any changes to a length, width, and height to the cover 300 are adjusted in correlation with the dimensions of the container 330 to enable the cover 330 to be able to completely cover the entirety of the items that are placed within the container 330. As the cover 330 can protect the entirely of the items, wherein no portion of any of the items are exposed to anything outside of the cover 300, the cover 300 along wand the container 330 can proceed to the carriage phase. A handle integrated on an exterior portion of the cover 300 may then be used to lift the cover 300 and container 330 in the horizontal direction.

The container 210 in FIGS. 2(*a*)-(*b*) and the cover 300 in FIGS. 3(*a*)-3(*e*) may both be adjusted to accommodate a pair of shoes or other items. The dimensions of the container 210 and the cover 300 are not static, and are continuously adjustable to enable a single item or a plurality if items to be placed within the container 210 and protected by the cover 300 with the right amount of space between the items and the dimensions of the container and cover to store the items securely.

Referring to FIG. 4, a two-piece sliding design of an integrated package and carrier 400 is illustrated. The integrated package and carrier 400 includes a cover 410. The cover 410 also includes an integrated handle 420 within the cover 410. Underneath the cover 410, a slidable container 430 is positioned, wherein the container 430 can slide in and out from underneath the cover 410 and can store items. A pair of shoes 440 can be stored within the container 430.

In FIG. 5, an integrated package and carrier 500 with a two-piece sliding design is also illustrated. A cover 510 is illustrated, with a handle 520 integrated within the cover. A slidable container 530 can easily slide in and out from underneath the cover 530 to store items. Various sizes and shapes of the slidable container 530 are illustrated.

Figures 6A, 6B, 6C, 6D:
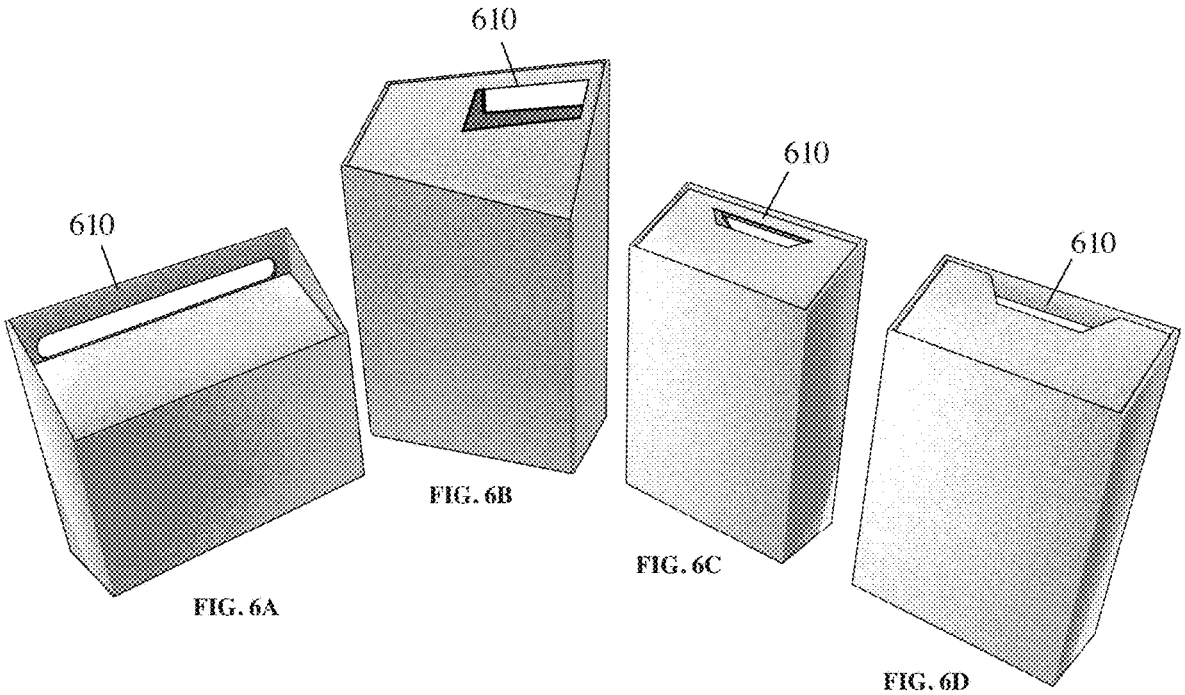
FIG. 6A-6D illustrates various diagrams of the integrated handle in accordance with an embodiment of the presently disclosed embodiments.

Referring to FIG. 6(*a*), the hybrid package and carrier (integrated carrier) 600 of is illustrated. The integrated carrier 600 can include a handle 610. The handle 610 is integrated onto the integrated carrier 600, and not attached by any external means. The handle 610 is part of the integrated carrier 600. The handle 610 can be used to lift and carry the integrated carrier 600 that includes the cover, pair of shoes, other items, and container described above. As shown in FIG. 6(*a*), the handle 610 can be lengthened to handle the particular items that are within the integrated carrier 600. Moreover, the handle 610 can be lengthened to more efficiently and effectively lift and carry the integrated carrier 600. If the handle 610 can effectively handle the weight of the entire integrated carrier 600 including any items that are inside, the handle 610 can be used to lift the integrated carrier 600 vertically, and also be used to carry the integrated carrier 600 in the horizontal direction.

In FIG. 6(*b*), a determination can be made that the handle 610 may need to be narrowed and also widened to correspond to the weight and adjusted dimensions of the integrated carrier 600. The container and cover which make up the integrated carrier 600 may need to be adjusted to add extra space for a larger set of items or a larger a pair of shoes in the integrated carrier 600. To handle the adjusted shape of the cover, and extra weight of any items within the integrated carrier 600, the handle 610 can be shortened and widened to provide a functional and effective lift and carry for the integrated carrier 600 that may not occur with a longer and narrower handle 610.

Referring to FIG. 6(*c*), the handle 610 can be further narrowed based on the preference of the user, or based on the type of items which may be inside of the integrated carrier 600. If lighter items such as a small notebook computer or book are within the integrated carrier 600, a handle that is narrower may be needed to ensure that the right amount of force is exerted to lift and carry the integrated carrier 600. The narrower handle 610 can ensure that excess or unnecessary force or pull is not used on the integrated carrier 600 when the handle 610 is used to lift and carry the integrated carrier 600. In addition, the narrower handle 610 can also correspond to the length and width and of the integrated carrier 600 being narrowed to reduce excess space for the stored items within the integrated carrier 600.

In FIG. 6(*d*), the handle 610 can be further lengthened and narrowed based on the type of items being stored within the integrated carrier 600, or the type of user that is preparing to lift and carry the integrated carrier 600. The user can prefer a longer and narrower handle that can enable the user to lift and carry the integrated carrier 600 more efficiently. Moreover, as described with respect to FIGS. 6(*a*)-6(*c*), the dimensions (length, width) can be adjusted based on the adjusted dimensions of the integrated carrier 600, and the items that the integrated carrier 600 is storing.

In FIGS. 6(*a*)-6(*d*), the handle 610 in its static position can be used to lift and carry the integrated carrier 600 without the need for a conventional shopping bag or the like. The handle 610 can also be dynamic, wherein the length and width of the handle 610 can be adjusted to make it more efficient to lift and carry either larger or smaller items which the integrated carrier 600 may be holding. Unlike the traditional shopping bag or attachable handle, the handle 610 can be used to adjust to the dimensions of the cover and the container and also adjust to to the items that need to be stored and carried. Accordingly, the integrated and adjustable handle 610 effectively eliminates the need for a traditional shopping bag to placed over the cover and container. In addition, the handle 610 eliminates the need for an external handle to be placed on the integrated carrier 600.

Referring to FIG. 7, a multi-carrier stacking system 700 is illustrated. A plurality of hybrid package and carriers 710 may be stacked upon each other for retail storage. The hybrid package and carriers 710 may also be stacked for both inventory management and shipping. Each of the hybrid package and carriers 710 may contain items such as books, notebook computers, shoes, etc.

In FIG. 8, another multi-carrier stacking system 800 is illustrated. Multiple hybrid package and carriers 810 may be stacked upon each other for retail storage. The hybrid package and carriers 810 may also be stacked upon each other for inventory management and shipping, and each of the hybrid package and carriers 810 may include a pair of shoes 820.

Referring to a FIG. 9, a process 900 for storing a pair of shoes within a trapezoidal container accompanied with a trapezoidal cover is described. At step 910, a container for storing a plurality of items is set at a first position. The container can have a trapezoidal configuration. The container can also be slidable to where it can slide in and out of a set position with a cover. The container can also be adjustable. The length and the width of the container can be adjusted. In addition, the height of the container may be adjusted as well. At step 920, a plurality of items are set at a second position. In an embodiment, the plurality of items can be a pair of shoes. In other embodiments, the plurality of items can be clothing, books, etc. The pair of shoes can be positioned in the container and stored within the container. At step 930, a cover with a trapezoidal shape can be set at a third position. The cover can be positioned over the container when the container has the pair of shoes or other items positioned within the container. The cover can be positioned over the container to protect the pair of shoes and/or other items that are being stored in the container. At step 940, a handle can be configured to an exterior portion of the cover. The handle can be integrated into the cover, and not separate from the cover. The handle can be set to lift the cover along with the plurality of items stored within the container.

A container with a trapezoidal shape can slide into a cover with a trapezoidal shape. The trapezoidal container can be separated from the trapezoidal cover to attempt to store a pair of shoes and/or other items. The dimensions of the trapezoidal container can be adjusted. The length and the width of the trapezoidal container can both be increased and decreased. In addition, the height of the trapezoidal container can also be increased or decreased to accommodate the pair of shoes or other items. Once the pair of shoes have been secured within the container, the trapezoidal cover can be placed over the container.

Those skilled in the art will appreciate that the example embodiments are non-exhaustive and that embodiments other than that described here may be included without departing from the scope and spirit of the presently disclosed embodiments.

Advantages

The trapezoidal container can be separated from the trapezoidal cover to attempt to store a pair of shoes and/or other items. The dimensions of the trapezoidal container can be adjusted. The length and the width of the trapezoidal container can both be increased and decreased, in addition, the height of the trapezoidal container can also be increased or decreased to accommodate the pair of shoes or other items. Once the pair of shoes have been secured within the container, the trapezoidal cover can be placed over the container The dimensions of the container may also be adjusted to accommodate the shoes or other items that the container has stored. The length and width of the cover can be either increased or decreased. Further, the height of the cover can also be adjusted to either increase or decrease to ensure that the shoes or other items are securely protected. The integrated handle can also be used to lift the cover along with the shoes and the container, and carry the container in the horizontal direction. Further, the integrated handle can also be used to flatten the cover to eliminate an unnecessary space between the shoes and the cover. The handle can also be used to increase the height of the cover to provide extra spacing to store a pair of shoes or other items.

The overall benefits can include not requiring a conventional shopping bag to carry the container, the pair of shoes, and the cover. In addition, the container, cover, and handle can each be adjusted to create more space for the shoes or other items, or reduce unnecessary space to ensure that the shoes or items are stored securely.

Conclusion

All references, including granted patents and patent application publications, referred herein are incorporated herein by reference in their entirety.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Various aspects of the invention have been described above by way of illustration, and the specific embodiments disclosed are not intended to limit the invention to the particular forms disclosed. The particular implementations of the Hybrid Package and Carrier provided thereof may vary depending upon the particular context or application. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

The corresponding structures, materials, acts, and equivalents of all means or step plus function elements in the claims below are intended to include any structure, material, or act for performing the function in combination with other claimed elements as specifically claimed.

What is claimed is:

1. A system comprising:

a container for storing a plurality of items set at a first position, wherein the container is configured with a trapezoidal configuration, wherein a front wall of the container includes an opening;

the plurality of items set at a second position, wherein the plurality of items are positioned within the container to enable the container to store the plurality of items; and a cover set at a third position with a trapezoidal shape, wherein the cover is configured with a same trapezoidal configuration as the container, wherein the cover has a greater length and width than the container, and wherein the cover is positioned over the container to protect the plurality of items stored within the container, wherein the cover includes a top wall, bottom wall, and multiple side walls, and wherein the top wall consists of a single opening at a front edge of the cover, wherein both openings are configured as a handle set to lift the cover simultaneously with the stored plurality of items and the container.

2. The system of claim 1, wherein the sidewall of the container that has the portion of the handle is configured to close a front opening of the container.

3. The system of claim 1, wherein the plurality of items include a plurality of shoes.

4. The system of claim 1, wherein the cover is made of recyclable material.

5. The system of claim 1, wherein a length of the plurality of items is configured to a set length greater than a length of each portion of the handle.

6. The system of claim 1, wherein a width of the portion of the handle configured as the opening in the cover is configured to a set width.

7. The system of claim 1, wherein each portion of the handle is configured to a set length.

8. A system comprising:

a trapezoidal container of a fixed length configured at a first position to store one or more items, wherein a front wall of the trapezoidal container includes an opening;

the one or more items positioned at a second position outside of the trapezoidal container, wherein the one or more items are narrower than a width of the trapezoidal container; and a trapezoidal cover positioned over the trapezoidal container, wherein the trapezoidal cover is configured to cover the trapezoidal container when the one or more items are positioned within the trapezoidal container, wherein the trapezoidal cover includes a top wall, bottom wall, and multiple side walls, and wherein the top wall consists of a single opening at a front edge of the trapezoidal cover, wherein both openings are configured as a handle set to lift the trapezoidal cover simultaneously with the stored plurality of items and the trapezoidal container.

9. The system of claim 8, wherein the one or more items are positioned within the trapezoidal container.

10. The system of claim 8, wherein the first and second portions of the handle are perpendicularly aligned when the trapezoidal cover is placed over an entire length and width of the trapezoidal container.

11. The system of claim 8, wherein the trapezoidal container includes a mobile device.

12. The system of claim 8, wherein the trapezoidal cover is positioned over a mobile device within the trapezoidal container.

13. The system of claim 8, wherein a length and width of the first portion of the handle is substantially similar to a length and width of the second portion of the handle.

14. The system of claim 8, wherein a width of the trapezoidal cover is greater than a width of the trapezoidal container.

15. A method comprising:

positioning a trapezoidal container at a first position, wherein the trapezoidal container is configured to store a plurality of items, wherein a front wall of the trapezoidal container includes an opening;

setting the plurality of items at a second position, wherein the plurality of items are positioned within the trapezoidal container; and placing a trapezoidal cover above the trapezoidal container, wherein the trapezoidal cover is positioned to protect the plurality of items and the trapezoidal container, wherein the trapezoidal cover has a greater length and width than the trapezoidal container, wherein the trapezoidal cover includes a top wall, bottom wall, and multiple side walls, and wherein the top wall consists of a single opening at a front edge of the trapezoidal cover, wherein both openings are configured as a handle set to lift the trapezoidal cover simultaneously with the stored plurality of items and the trapezoidal container.

16. The method of claim 15, wherein the length of the trapezoidal container is configured to a fixed length.

17. The method of claim 15, wherein a width of the trapezoidal cover is configured to a set width.

18. The method of claim 15, wherein the width of the trapezoidal container is greater than a width of the plurality of items.

19. The method of claim 15, wherein the portions of the handle have an equal length.

20. The method of claim 15, wherein a width of both portions of the handle are less than a width of the plurality of items.

* * * * *